United States Patent [19]

Roberts

[11] 3,951,080

[45] Apr. 20, 1976

[54] CONCEALED HARDWARE FOR ADJUSTABLE SHELVING

[76] Inventor: Wallace M. Roberts, 508 North Ave. East, Missoula, Mont. 59801

[22] Filed: Oct. 6, 1975

[21] Appl. No.: 619,665

[52] U.S. Cl. ..... 108/109; 211/186; 248/247

[51] Int. Cl.[2] ..... A47F 5/00; E06B 7/28

[58] Field of Search ..... 108/106, 109, 152, 110; 211/148; 248/243, 247, 248

[56] References Cited

UNITED STATES PATENTS

| | | | |
|---|---|---|---|
| 754,817 | 3/1904 | Schriefer | 108/109 |
| 2,005,593 | 6/1935 | Onions et al. | 108/109 |
| 2,375,726 | 5/1945 | Bales | 108/109 |
| 2,846,080 | 8/1958 | Freeman | 248/247 X |
| 3,326,149 | 6/1967 | Mitchell et al. | 211/148 X |
| 3,401,652 | 9/1968 | Thor | 108/106 |
| 3,606,227 | 9/1971 | Klein | 248/243 |
| 3,612,289 | 10/1971 | Zink | 211/148 |

*Primary Examiner*—J. Franklin Foss

[57] ABSTRACT

Paired opposed bracket supports having plural spaced grooves are carried by opposed vertical edges of cooperating spaced shelving stanchions to releasably receive opposed cooperating shelf brackets carried thereby and adjustably supporting a shelf between stanchions. With use of edge trim the shelving hardware is substantially concealed for aesthetic desirability.

3 Claims, 4 Drawing Figures

CONCEALED HARDWARE FOR ADJUSTABLE SHELVING

BACKGROUND OF INVENTION

Related Applications

There are no applications related hereto now filed in this or any foreign country.

Field of Invention

This invention relates generally to hardware for adjustable shelving and more particularly to such hardware that may be substantially concealed for aesthetic desirability.

Description of Prior Art

Modular vertically adjustable shelving has become much used and a desirable item of commerce in the present day culture. Much of such shelving and the hardware necessarily associated therewith has been created primarily for utilitarian purposes rather than aesthetic appeal and by reason of this the associated hardware has generally not been concealed except in such fashion as might be incidental to the structure itself.

The instant invention seeks to provide a unique form of such hardware that has all of the functional utility of the known art but yet allows concealment for aesthetic appeal. The disclosed construction is adapted particularly to the formation of wooden shelves from laminated material such as plywood. In this instance it provides all of the functional utility of the non-concealed type of adjustable shelving hardware but yet by reason of its configuration and positioning allows concealment in the normal course of such wooden shelving construction process without any substantial modifications or changes in the process.

SUMMARY OF INVENTION

My invention provides similar paired opposed bracket supports, having horizontal grooves in their external surfaces, carried on the side edges of vertical, spaced cooperating shelving stanchions. Paired opposed shelving brackets, each having "U" shaped spaced fastening legs extending from one surface and a shelving flange extending from the other are positioned with shelving flanges facing each other and supported by the fastening legs in bracket support grooves on the opposed cooperating stanchions to receive a shelf therebetween and releasably support it between the stanchions. Edge trim is provided over the exposed bracket supports and shelving edges to substantially conceal the shelving hardware.

The primary object of my invention is to provide concealed hardware for adjustable modular shelving, particularly of a laminate-type wood construction.

A secondary object of my invention is to provide such hardware that may be installed and used with such shelving in the course of normal present day construction without any material changes therein.

A still further object of my invention is to provide hardware of this nature that is of new and novel design, of rugged and durable nature, of simple and economic manufacture and otherwise well adapted to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being set forth in the accompanying drawings as required.

BRIEF DESCRIPTION OF THE DRAWINGS

In the accompanying drawings which form a part of the specification, and in which like members of reference refer to similar parts throughout.

DESCRIPTION OF THE PREFERRED EMBODIMENT

Figure 1:
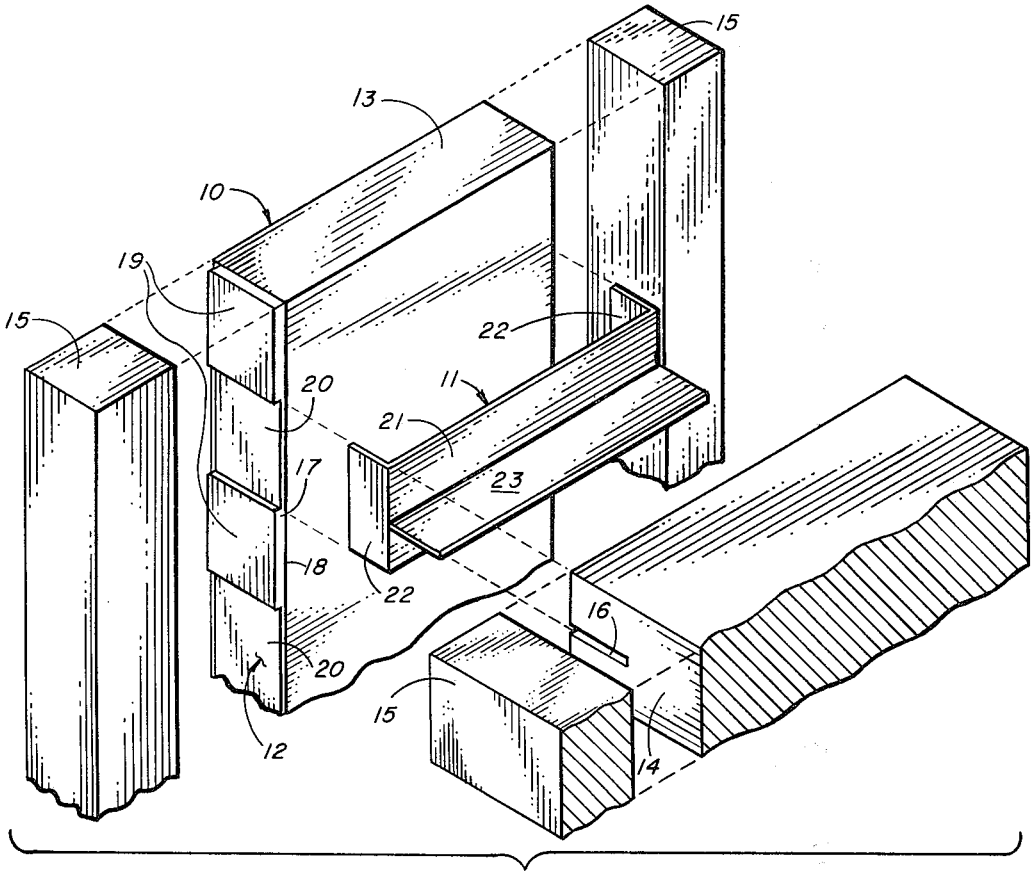
FIG. 1 is an exploded, isometric view of a portion of the hardware of my invention with associated stanchions, shelving and trim, showing its parts, their configuration and arrangement.
Figure 2:
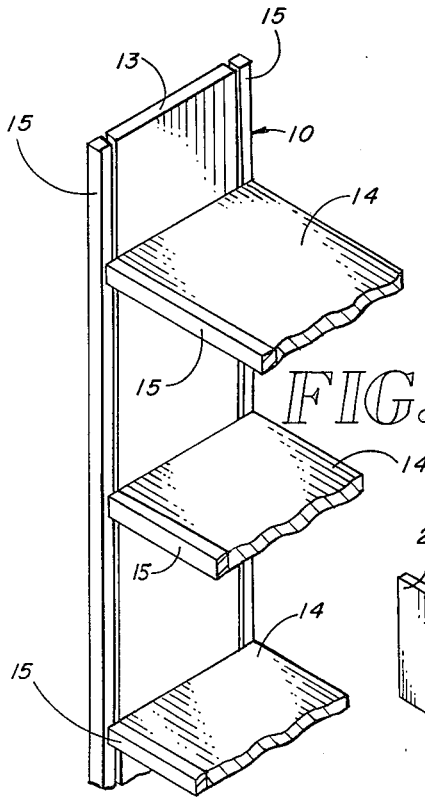
FIG. 2 is a partial, cut-away isometric view of a section of assembled shelving showing trim in place to conceal the hardware of my invention.
Figure 3:
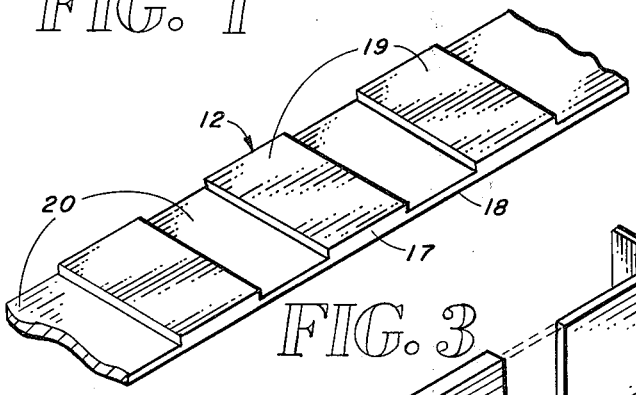
FIG. 3 is a section of the vertical bracket support of my invention showing its grooved surface configurations and details of construction.

Referring now to the drawings in more detail and particularly to that of FIG. 1, it is there seen that my invention generally comprises elongate bracket supports 12, carried on the vertical edges of upright stanchions and having spaced cooperating grooves to receive a plurality of pairs of shelf brackets 11 to support plural horizontal shelves between stanchions and yet be covered with trim elements to form a complete shelving unit 10 with substantially concealed hardware.

Shelving unit 10 includes at least two cooperating, spaced, vertical stanchions 13 normally of a width substantially greater than thickness and of a length (vertical extension) substantially greater than either and at least one horizontal shelf 14 normally of a thickness and width similar to that of vertical stanchions 13. To form a normally operative shelving unit, the spaced cooperating vertical stanchions 13 must be relatively rigidly positioned relative each other in a spaced, substantially parallel relationship. This is preferably, but not necessarily, accomplished by affixing the stanchions to some common rigid supporting base (not shown) or by firmly affixing them to some peripheral supportative element (not shown) usually at the top, bottom or both. This structure, however, is only generally a prerequisite to the instant invention, comprises no part of the invention per se and is therefore not dealt with in detail because it is well known in the prior art.

Normally in today's commerce, when shelving such as described is formed from wood it commonly will be formed from a composite laminated-type plywood. In the present day view of shelving aesthetics, it appears to be undesirable to have an exposed plywood edge in any furniture and in shelving in particular. The instant invention is especially concerned with such materials and such type of construction. In this construction it is common to place trim strips 15 of wood facing on the exposed edges of the plywood elements showing lamination. Such facing 15 is normally relatively thin in a dimension perpendicular to the plywood edge and of width equal to that of the plywood edge to nicely cover it. In the present day practice this trim 15 is normally structurally maintained in position by mechanical fastening, commonly nailing, stapling or gluing.

Bracket support 12 provides elongate strip-like body 17 with planar back 18 with face 19 configured with alternating rectangular grooves 20. The whole bracket support is relatively thin and of a width equal to or slightly less than the thickness of stanchion 13 upon which it is carried. Grooves 20 are formed so slidably receive legs 22 of shelf bracket 11 and preferably are of a depth substantially equal to the thickness of the bracket legs to provide a nice fit of trim thereover. The length of a particular support bracket normally will be substantially the same as the vertical dimension of stanchion 13 which carries it though obviously it may be less if shelving is not desired to be potentially positionable over the entire vertical extent of the stanchion. Similar brackets are mechanically fastened to each of the vertical side edges of a stanchion 13 in such fashion that the grooves of each of a paired set will be co-planar in a plane perpendicular to the vertical stanchion that would also be substantially horizontal when the stanchion is in normal vertical supportative position.

The bracket support is preferably formed from some reasonably rigid, structurally durable material such as metal, though undoubtedly plastics and even wood fiber materials might be used in appropriate applications. The mechanical fastening (not illustrated) of the bracket supports to vertical stanchions is in the instance illustrated accomplished by means of gluing with an appropriate adhesive, but other means of mechanical joinder such as nailing, screwing or the like might serve the purpose of my invention. The type of mechanical joinder used obviously must be appropriate to give the joined structure sufficient joint strength to serve the purposes desired of it.

Shelf bracket 11 comprises planar body 21, of length equal to the distance between opposed faces of cooperating grooves 20 of the bracket supports of a stanchion, with supporting legs 22 perpendicularly extending in one direction from the body to be slidably received by the supporting grooves of cooperating bracket supports and planar shelf tenon 23 perpendicularly extending in the opposite direction from the opposite body surface to receive and support the end of a shelf. Planes parallel to the principal surfaces of supporting legs 22 and shelf tenon 23 would be mutually perpendicular, all as more clearly illustrated, especially in FIG. 1 of the accompanying drawings.

The length of supporting legs 22 is preferably substantially the same as the width of the bracket support if stanchions are to support shelving only on one side and slightly less than half this length if shelving is to be supported by opposed shelf brackets on both sides of a stanchion. Neither the leg length nor shelf tenon length are critical to my invention so long as sufficient to provide support in cooperation with the associated elements. Normally the thickness of supporting legs 22 of the shelf bracket will be equal to the depth of the grooves 20 of the associated bracket support so that there will be no projection of any hardware, when assembled, beyond the surface or face 19 of the bracket support.

Again, shelf bracket 11 is preferably formed from a reasonably rigid durable material so that it might be relatively thin. Metal is preferred but undoubtedly plastic, wood fiber products or some similar material might serve the purpose of my invention.

The end shelf 14 is provided with medial groove 16 of appropriate dimension to receive tenon 23 of the shelf bracket in a nice comfortable fit. This groove normally will be formed in the shelf end members by sawing, milling or some similar process. The groove is so oriented that a plane parallel to a principle surface defining the groove will also be parallel to the principle surface of the shelf member wherein it is defined.

Figure 4:
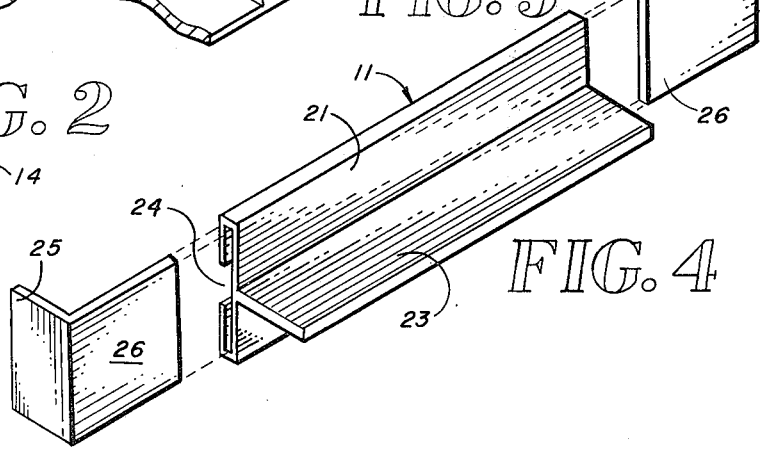
FIG. 4 is an exploded, isometric surface view of a compound, extruded-type species of shelf bracket of my invention, showing its parts, their configuration and relationship.

The unitized shelf bracket illustrated in FIG. 1 is somewhat difficult of formation and expensive when produced by normal manufacturing methods, as it normally would require either casting, machining, welding or some combination thereof. A compound bracket of similar configuration but one more readily adapted to economic methods of modern manufacturing is illustrated in FIG. 4. Here the body member is formed with T-shaped channel 24 on the side opposite that carrying the shelf tenon. This structure comprises a ruled prism that may be quite conveniently formed by extrustion and cut to desired length. Supporting legs 25, serving the same function as supporting legs 22 of the unitary structure, are L-shaped elements with holding 26 adapted to be slidably received within the opposed ends of T-shaped channel 24. The L-shaped supporting leg member may also be formed by extrusion and cut to length so that the whole composite shelf bracket illustrated in FIG. 4 might be quite conveniently and economically formed and assembled to yet serve the same purpose as the more costly unitary species illustrated in FIG. 1.

Trim elements 15 are carried on the upright stanchions immediately outwardly adjacent faces 19 of the support brackets and on shelves 14 immediately outwardly adjacent the exposed edges. The trim is maintained in desired position by mechanical fastening (not shown), in the instance illustrated by gluing. Other mechanical fastening means such as nailing, screwing or the like might be used if the fastener be countersunk and the resulting hole appropriately filled.

It is to be noted in using a rectilinear type trim that there will be a space equal to the thickness of the bracket support between the vertical trim and its supporting vertical stanchion. If this be not desired, the bracket support may be configured slightly smaller than the vertical edge of its supporting stanchion and an appropriate recess may be milled in the trim to allow it to fit over the bracket support so that there will be no space between the trim and stanchion edge. Normally, however, the line of non-joinder between the surfaces of these elements causes no particular aesthetic problem, may even be a desirable feature of design, and does not justify the difficulty and cost of elimination of the problem. The method of joinder described is well known in the furniture arts and therefore has not been illustrated in detail. It should further be noted, however, that if the trim be milled to fit over the bracket supports, appropriate portions will have to be removed to allow passage of bracket legs, and this limits or negates adjustability.

From the foregoing description of my invention its operation may now be understood.

Stanchions 13 and shelving 14 of appropriate dimension are formed with appropriate width according to the foregoing description. Strips of bracket support 12 are cut to appropriate length and positioned on each of the vertical side edges of the stanchions so that when the stanchions are in final supportative position each of the grooves of each bracket support on each stanchion will be substantially co-planar. In this position the bracket supports are mechanically fastened to the stanchion. Trim 15 is then fastened outwardly adjacent the surface of the bracket support to substantially conceal it. When so assembled the stanchions are positioned in a spaced parallel relationship, normally substantially vertically oriented. The stanchions are maintained in this position either by mechanical affixation to some common supporting structure such as a floor or shelf (not shown) or by means of some external, normally peripheral, support (not shown).

Horizontal shelves 14 of the desired number are then cut to appropriate length to extend between the opposed faces of shelf brackets carried in cooperating opposed positions by the two vertical stanchions. The medial grooves 16 to receive shelf tenons 23 are defined in each end of each shelf as described, and trim 15 is fastened on the exposed edges. It should be noted that the shelf trim will have to be thicker, by the thickness of the bracket support, than the stanchion trim to present a flush edge when assembled (unless the stanchion trim be routed).

To assemble the shelving then, cooperating exposed shelf brackets are positioned, normally at the same vertical level, on each of the opposed vertical stanchions in such fashion that the shelf tenons face each other. The shelf is then positioned immediately adjacent these two shelf brackets with medial grooves 16 aligned with shelf tenons 23 and then manually moved inwardly toward the shelf tenon until properly positioned thereover. Each shelf in succession is positioned as desired in the same fashion and thereupon the shelving structure is complete.

It is to be noted that if desired, supporting legs 22 of shelf bracket 11 might be mechanically fastened in grooves 20 supporting the shelf bracket and that tenon 23 might be similarly mechanically fastened within medial grooves 16 of a shelf. This fastening might be accomplished either by releasable or permanent means. The fastening, however, normally is not necessary and since it would be obvious to one skilled in the art it is not considered to be a part of the instant invention.

It should be further noted that the shelving units as described might be used in horizontal co-planar adjacency with only one vertical stanchion shared in common between two units.

Having thusly described my invention, what I desire to protect by Letters Patent, and

What I claim is:

1. In a shelving structure having similar spaced cooperating normally vertical stanchions adjustably supporting plural normally horizontal shelves therebetween, substantially concealed hardware adjustably connecting the shelves and stanchions, comprising, in combination:

plural elongate bracket supports of a width not greater than stanchion thickness, with a planar back and with plural spaced grooves in the face thereof defined by sides perpendicular to the longer dimension of the bracket support to receive a supporting leg of a shelf bracket in a slidable fit, one of said supports being mechanically fastened to each side edge of each vertical stanchion in such position that the grooves of all cooperating bracket supports on a set of cooperating stanchions are substantially co-planar when the stanchions are in supporting position, and;

plural shelf brackets, each having a relatively thin planar body of length substantially equal to the distance between the oppositely facing surfaces of opposed cooperating grooves of the bracket supports carried by one stanchion, with similar paired opposed supporting legs extending perpendicularly from the ends of the body, said supporting legs configured to slidably fit within cooperating grooves of the opposed bracket supports on a vertical stanchion and with a relatively thin planar tenon extending perpendicularly away from the body in the opposite direction from the supporting leg extension, the length of said tenon being no greater than the width of the body and the orientation of its major aerial surface being substantially horizontal when the shelf bracket be carried by a stanchion in normal vertical supportative position;

a plurality of horizontal shelves of width substantially equal to that of the vertical stanchion, each shelf having a groove in the medial part of each end, said grooves being configured to slidably receive the tenons of opposed cooperating shelf brackets carried by opposed cooperating vertical stanchions when the shelf be interposed therebetween; and plural trim pieces configured to cover and mechanically fasten to each bracket support and the exposed edges of shelves to cover said surfaces.

2. The invention of claim 1 wherein the shelf bracket is compoundedly formed from extrudable elements characterized by:

the stanchion facing side of the body being formed with a channel configured to slidably receive and support supporting legs comprising L-shaped elements having one leg of the L-shaped element configured to slidably fit within and be retained by the channel of the body and the other leg to serve as a supporting leg of the shelf bracket.

3. The invention of claim 1 further characterized by:

the bracket supports being slightly smaller than the vertical edges of the stanchions covered thereby and being medially positioned on the stanchions to leave an uncovered peripheral area of the stanchion about the bracket support; and the stanchion support trim pieces being relieved on the stanchion facing surface to fit about the bracket support and immediately adjacent to the uncovered peripheral area of the vertical stanchion.

* * * * *